US005263227A

United States Patent [19]

Hrbek et al.

[11] Patent Number: 5,263,227

[45] Date of Patent: Nov. 23, 1993

[54] SINGLE HUNG SELF ALIGNING DOOR HINGE

[75] Inventors: Daniel J. Hrbek, Keego Harbor; George E. Marks, Commerce Twp., Oakland County, both of Mich.

[73] Assignee: General Motors Corporation, Detroit, Mich.

[21] Appl. No.: 885,081

[22] Filed: May 18, 1992

[51] Int. Cl.[5] ..... E05D 7/00; E05D 7/06

[52] U.S. Cl. ..... 16/224; 16/239

[58] Field of Search ..... 16/224, 239

[56] References Cited

U.S. PATENT DOCUMENTS

| | | | |
|---|---|---|---|
| 3,594,853 | 7/1971 | Slattery | 16/163 |
| 4,542,558 | 8/1985 | Brockhaus | 16/263 |
| 4,628,567 | 12/1986 | Brockhaus et al. | 16/267 |

FOREIGN PATENT DOCUMENTS

| | | | |
|---|---|---|---|
| 417213 | 10/1934 | United Kingdom | 16/224 |
| 454819 | 10/1936 | United Kingdom | 16/224 |

*Primary Examiner*—Lowell A. Larson

*Assistant Examiner*—Carmine Cuda

*Attorney, Agent, or Firm*—William A. Schuetz

[57] ABSTRACT

A door hinge assembly pivotably mounts a vehicle door member to a body structure member. The assembly includes a first hinge strap mounted to one of the members and having a vertical opening. A second hinge strap is mounted to the other member and has a spherical concave surface. A hinge pin is interposed between the hinge straps. The hinge pin has a portion received by the vertical opening of the first hinge strap. The hinge pin has a spherical convex surface for engaging the concave surface of the second hinge strap allowing variance in relative orientation of the hinge pin to the second hinge strap. The hinge pin is rotatably retained to one of the hinge straps allowing pivotable movement between the members. A removable retention bolt is carried between the hinge pin and the other hinge strap for retaining the hinge pin to the other hinge strap. The retention bolt allows removable retention of the door member to the body structure member. The concave and convex surfaces allow for variance in relative orientation of the hinge pin to the second hinge strap.

2 Claims, 2 Drawing Sheets

SINGLE HUNG SELF ALIGNING DOOR HINGE

BACKGROUND OF THE INVENTION

This invention relates to a single-hung door hinge assembly and more particularly to a door hinge assembly having a pair of mating spherical surfaces for allowing variance in alignment of the hinge straps.

It is known to have a hinge assembly to support a door on a body structure of a vehicle which allows the door to pivot in relation to the body structure. The hinge assembly consists of a pair of hinge straps with an interconnecting hinge pin. It is known to use a single hung door hinge, where one of the hinge straps is positioned above the other hinge and connected by the interconnect hinge pin whereby the hinge straps do not intermesh.

It is also known to use two separate single hung hinge assemblies to attach the vehicle door to the body structure and mount the hinge assemblies in the same direction with the movable hinge strap, which is mounted to the vehicle door, located above the stationary hinge strap. This allows the door to be removed from the vehicle for manufacturing and maintenance by removing a retaining bolt, which disassembles the hinge pin from one of the straps, and lifting the door. U.S. Pat. No. 4,542,558 discloses a single-hung hinge which has a hinge pin shaped so that it is non rotatable relative to one of the hinge straps and allows the hinge strap and door to be reinstalled on the hinge pin and returned to their originally adjusted position. The hinge assembly must be properly aligned initially in the vehicle.

It is also known that hinge assemblies work with the greatest ease and least wear when the axis of rotation of the hinge assemblies are aligned in a single axis.

It is also recognized that slight variations in the body structure from the desired or proper plane as the result of build variations might make it more difficult to align the axis of the hinge assemblies in a single axis. It would be desirable to have a single-hung hinge assembly which provides for variance in the orientation of the hinge pin relative to one of the hinge straps thereby allowing the hinge pin to be aligned with the other hinge strap and the axis of rotation of the hinge assembly.

SUMMARY OF THE INVENTION

This invention provides a door hinge assembly to pivotably mount a vehicle door member to a body structure member. The assembly includes a first hinge strap mounted to one of the members and having a vertical opening. A second hinge strap is mounted to the other member and has a spherical concave surface. A hinge pin is interposed between the hinge straps. The hinge pin has a portion received by the vertical opening of the first hinge strap. The hinge pin has a spherical convex surface for engaging the concave surface of the second hinge strap allowing variance in relative orientation of the hinge pin to the second hinge strap. The hinge pin is rotatably retained to one of the hinge straps allowing pivotable movement between the members. A removable retention bolt is carried between the hinge pin and the other hinge strap for retaining the hinge pin to the other hinge strap. The retention bolt allows removable retention of the door member to the body structure member. The concave and convex surfaces allow for variance in relative orientation of the hinge pin to the second hinge strap.

One object, feature and advantage resides in the provision of a hinge assembly having a pair of hinge straps and a hinge pin, whereby the hinge pin varies in alignment or orientation with one of the hinge straps allowing alignment with the other hinge strap.

Another object, feature and advantage resides in the provision of a hinge assembly, which allows the vehicle door to be removed by removing a bolt and lifting the door, and also allows the hinge pin to vary in alignment or orientation with one of the hinge straps thereby maintaining alignment with the other hinge strap.

Further objects, features and advantages of the present invention will become more apparent to those skilled in the art as the nature of the invention is better understood from the accompanying drawings and detailed description.

DESCRIPTION OF THE PREFERRED EMBODIMENT

Figure 1:
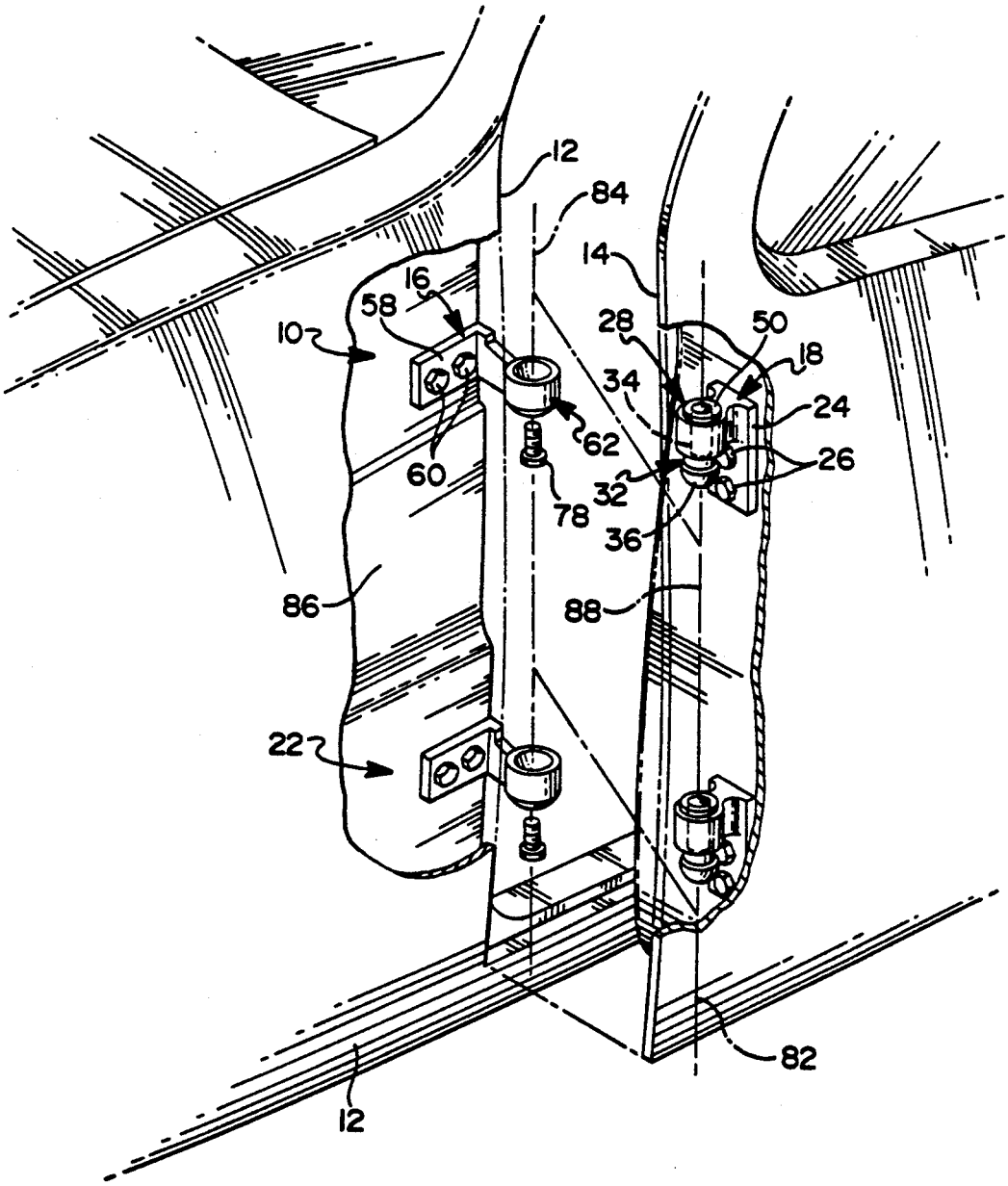
FIG. 1 is an exploded view of the hinge assembly of the invention mounted on a vehicle body and door structure.

Referring to FIG. 1, the hinge assembly of the invention, designated generally at 10, is shown in place on a vehicle body structure member 12 and a vehicle door member 14. The hinge assembly 10 can be used with any vehicle door, but is disclosed as the hinge assembly 10 for a front driver side door. The hinge assembly 10 includes a pair of hinge straps, a stationary hinge strap, designated generally at 16, and a movable hinge strap, designated generally at 18.

Figure 2:
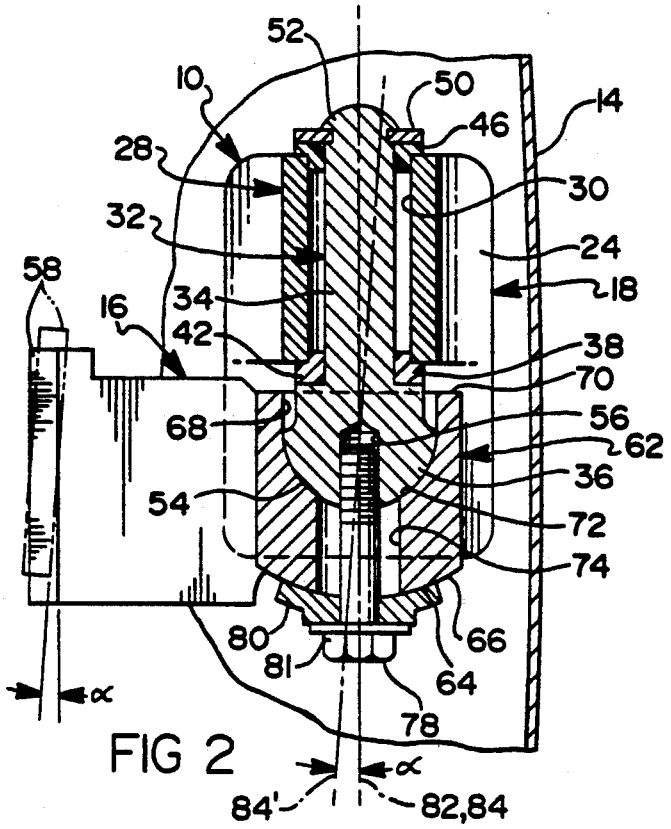
FIG. 2 is a sectional view of a hinge assembly.

The movable hinge strap 18 has a base 24 secured to door 14 by a pair of bolts 26. Referring to FIG. 2, a hinge pin receptacle 28 of the movable hinge strap 18 has a cylindrical vertical opening or hinge eye 30 to receive a hinge pin 32.

Referring to FIG. 2, the hinge pin 32 is generally cylindrical and has an upper portion 34 and a lower portion 36 where the upper portion 34 has a smaller diameter than the lower portion 36. The upper portion 36 is received by the vertical opening 30 of the movable hinge strap 18 with a pair of interposed bushings 42 and 46 allowing for rotatable movement between the hinge pin 32 and the movable hinge strap 18. A top surface 52 of the hinge pin 32 is peened to a washer 50, securing the two bushings 42 and 46 and the movable hinge strap 18 on the hinge pin 32.

The lower portion 36 of the hinge pin 32 has a lower surface, a hemispherical convex surface 54, as seen in FIG. 2. The hemispherical convex surface 54 projects upward to an outside diameter greater than the shoulder 38 of the hinge pin 32. A tapped or internally threaded hole 56 opens onto the undermost portion of the hemispherical convex surface 54.

Referring back to FIG. 1, the stationary hinge strap 16 has a base 58 secured to the vehicle body structure 12 by a pair of bolts 60. Referring to FIG. 2, a hinge pin receptacle portion 62 of the stationary hinge strap 16 has a lower edge 64 with a partial spherical convex surface 66. A bore 68 formed downward from an upper edge 70 of the hinge pin receptacle portion 62 has a hemispherical concave lower surface 72 for receiving the hemispherical convex surface 54 of the hinge pin 32. A hole 74 extends between the hemispherical concave surface 72 and the partial spherical convex surface 66 of the hinge pin receptacle portion 62 of the stationary hinge strap 16.

A retainer bolt 78 is threaded through a partial spherical concave washer 80 and the hole 74 in the hinge pin receptacle portion 62 of the stationary hinge strap 16 and received by the threaded hole 56 in the hinge pin 32. The partial spherical concave washer 80 engages a head 81 of the retainer bolt 78 and the partial spherical convex surface 66 of the stationary hinge strap 16 allowing the bolt 78 to snugly hold the hemispherical convex surface 54 of the hinge pin 32 against the hemispherical concave lower surface 72 of the stationary hinge strap 16. However, the hemispherical convex surface 54 of the hinge pin 32 can move relative to the hemispherical concave lower surface 72 of the stationary hinge strap 16 prior to the retainer bolt 78 being tightened.

Referring to FIGS. 1 and 2, the hole 74 in the stationary hinge strap 16 has a large enough diameter to allow relative change in orientation, as shown by an angle $\alpha$, between a vertical axis 82 of the hinge pin 32, which extends along the hole 56 which opens onto the hemispherical convex surface 54, and a vertical axis 84 of the stationary hinge strap 16, which extends along the hole 74. FIG. 2 shows a vertical axis 84' which is shifted by the angle $\alpha$ from the vertical axis 82. This change in relative orientation or position of the vertical axes is done without the binding of the hinge pin 32 or the retaining bolt 78 with the hinge strap 16.

Referring to FIG. 1, a second hinge assembly 22, identical to the first hinge assembly 10, works in conjunction with the first hinge assembly 10 to rotatably mount the door 14 to the vehicle body structure 12. A door swing axis 88, which is the axis of rotation of the door, runs through the vertical axes of the hinge pins 32 of both hinge assemblies 10 and 22.

Referring to FIGS. 1 and 2, the door 14 is initially installed on the vehicle body structure 12 by assembling the hinge assemblies 10 and 22. The movable hinge strap 18, which is rotatably connected to the hinge pin 32, is attached to the stationary hinge strap 16 by the hinge pin 32 being seated in the bore 68 of the stationary hinge strap 16. The retainer bolt 78 is inserted through the partial spherical concave washer 80 and the hole 74 in the stationary hinge strap 16 and threaded into the tapped hole 56 in the hinge pin 32, but not tightened. The hinge assemblies 10 and 22 are mounted to the door 14 by the base 24 of the movable hinge strap 18 being bolted to the door 14. The movable hinge straps 18 of the hinge assemblies are located on the door 14 to ensure alignment with the door swing axis 88 running through the vertical axes of hinge pins 32 of both hinge assemblies 10 and 22.

The base of the stationary hinge strap 16 is then bolted to the body structure whereby the door 14 with the hinge assemblies 10 and 22 is mounted on the body structure 12. The vertical axes 84 of the the stationary hinge straps 16 need not be aligned. Referring to FIG. 2, such mis-alignment might result from variations in a pillar 86 of the body structure 12 where the base 58 of the stationary hinge strap 16 is mounted, such as not being in the proper plane, or the hinge strap 16 not properly aligned on the pillar 86. A variation by angle $\alpha$ where the base 58 of the stationary hinge strap 16 is mounted to the pillar 86 will result in relative change of orientation, as represented by angle $\alpha$, between the vertical axis 82 of the hinge pin 32 and the vertical axis 84 of the the stationary hinge strap 16, with the hemispherical convex surface 54 moving relative to the hemispherical concave lower surface 72.

After the door 14, including the hinge assemblies 10 and 22, is mounted to the body structure 12, the retainer bolt 78 is tightened, so that the hinge pin 32 is clamped into place relative to the stationary hinge strap 16 with the adjustment for the variation of the vertical axes. The hinge pin 32, as retained, is automatically aligned with the door swing axis 88, which is the rotation axis of the door.

The vehicle door 14 can be easily removed by removing the retainer bolts 78 and lifting the door 14 with the movable hinge strap 14 and hinge pin 32 and then replaced without altering the fit of the vehicle door 12.

Figure 3:
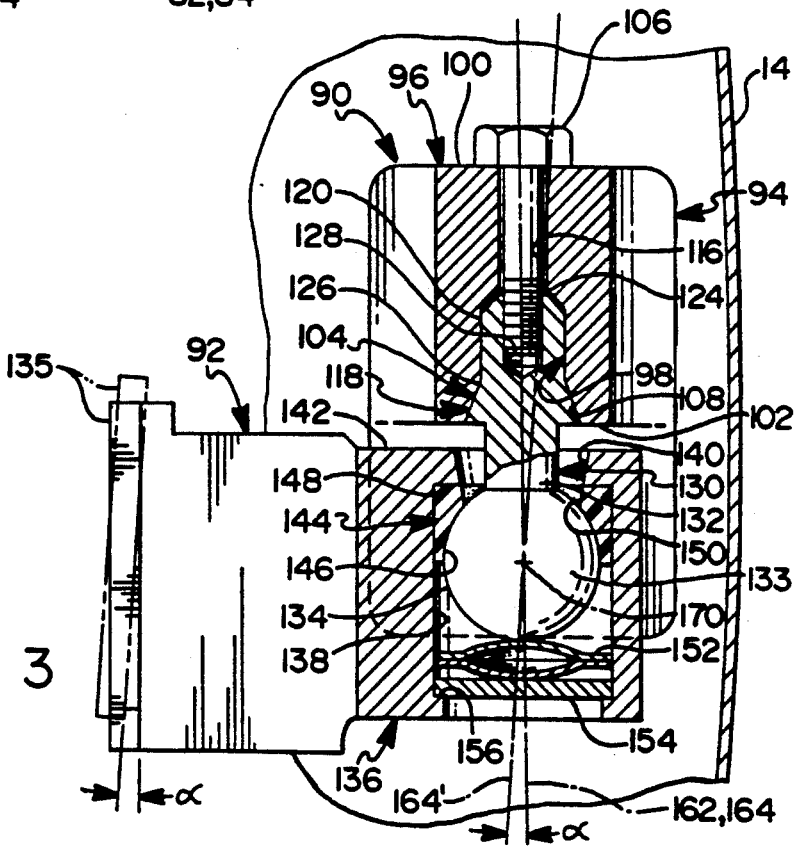
FIG. 3 is a sectional view of a hinge assembly of a second embodiment.

A second embodiment of the invention, shown in FIG. 3, has a hinge assembly 90 for placement on the vehicle body structure 12 and the vehicle door 14. The hinge assembly 90 includes a pair of hinge members, a stationary hinge strap 92 and a movable hinge strap 94.

The movable hinge strap 94 has a base secured to the vehicle door 14 by a pair of bolts in an identical manner as the first embodiment. A hinge pin receptacle portion 96 of the movable hinge strap 94 has a vertical hole 98 extending between an upper edge 100 and a lower edge 102 for receiving a hinge pin 104 and a retaining bolt 106. The hole 98 varies in diameter as it extends from the lower edge 102 to the upper edge 100 of the hinge pin receptacle portion 96 and has a conical portion 108.

The hinge pin 104 has an upper portion 118 with a generally cylindrically shaped side wall 120. A tapped hole 128 opens onto an upper surface 124 of the hinge pin 104 for receiving the retaining bolt 106. A conical section 126 of the upper portion 118 projects downward and outward from the cylindrically shaped side wall 120 for engaging the conical portion 108 of the hole 98 of the movable hinge strap 94. A lower portion 130 of the hinge pin 104 depends downward from the conical section 126 of the upper portion 118 and has a cylindrical shaft 132 ending in a sphere 133 having a partial spherical convex surface 134.

Referring to FIG. 3, the stationary hinge strap 92 has a base 135 secured to the vehicle body structure 12 by a pair of bolts in an identical manner as the first embodiment. A hinge pin receptacle portion 136 of the stationary hinge strap 92 has a cylindrical bore 138 opening downward. A tapered hole 140 extends from an upper surface 142 of the hinge pin receptacle portion 136 and narrows as it opens into the cylindrical bore 138.

A plastic bearing 144 is located at an upper end 148 of the cylindrical bore 138 and has a hemispherical concave surface 146 which opens downward. A tapered hole 150 in the plastic bearing 144 aligns with the tapered hole 140 in the hinge pin receptacle portion 136 to form one continuous tapered hole. The hemispherical concave surface 146 of the plastic bearing 144 engages the partial spherical convex surface 134 of the hinge pin 104 with the upper portion 118 of the hinge pin 104 protruding through the tapered holes 150 and 140.

A frustoconical "bellville" washer 152 is located in the cylindrical bore 138 of the hinge pin receptacle portion 136 and preloads the hinge pin 104 for ensuring engagement of the partial spherical convex surface 134 of the hinge pin 104 with the plastic bearing 144, thereby maintaining the hinge pin 104 in the desired position.

A metal plate 154 located in the cylindrical bore 138 and a lower edge 156 of the hinge pin receptacle portion 136, which is peened over, secure the plastic bearing 144, the hinge pin 104 and the bellville washer 152 in the cylindrical bore 138.

The partial spherical convex surface 134 of the hinge pin 104 can move relative to the hemispherical concave surface 146 of the plastic bearing 144 of the stationary hinge strap 92. The tapered holes 140 and 150 in the stationary hinge strap 92 and the plastic bearing 144 are of a large enough diameter to allow relative change in orientation, as shown by an angle $\alpha$, between a vertical axis 162 of the hinge pin 104, which extend along the upper and lower portions 118 and 130, and a vertical axis 164 of the stationary hinge strap 92, which extends along the cylindrical bore 138. FIG. 3 shows a vertical axis 164' which is shifted by the angle $\alpha$ from the vertical axis 162. This change in relative orientation or position of the vertical axes is done without binding the hinge pin 104 including the cylindrical shaft 132 with the hinge pin receptacle portion 136.

Similar to the first embodiment, a second hinge assembly, identical to the first hinge assembly 90, works in conjunction with the first hinge assembly to rotatably mount the door 14 to the vehicle body structure 12. The door swing axis, which is the axis of rotation of the door, runs through a pivot center 170 of the sphere 133 of the hinge pins 104 of both hinge assemblies 90.

The door 14 is initially installed on the vehicle body structure by assembling the hinge assemblies 90. The hinge pin 104 is rotatably mounted to the stationary hinge strap 92 with the bellville washer 152 ensuring contact between the hinge pin 104 and the plastic bearing 144. The hinge pin receptacle portion 96 of the movable hinge strap 94 is slid over the hinge pin 104. The retaining bolt 106 is inserted in the hinge pin receptacle portion 96 from the upper edge 100 and is received by the tapped hole 128 of the hinge pin 104. The retaining bolt 106 is tightened until the conical section 126 of the hinge pin 104 is firmly engaged with the conical portion 108 of the hole 98. The hinge pin 104, as retained, does not rotate relative to the movable hinge strap 94.

The hinge assemblies 90 are mounted on the door 14 by the base of the movable hinge strap 94 being bolted to the door similar to the first embodiment. However, the vertical axes 162 of the hinge pins 104 need not be aligned for smooth "bind free" door swing operation as explained below.

The base 135 of the stationary hinge strap 92 is then bolted to the body structure 14 whereby the door 14 with the hinge assemblies 90 is mounted on the body structure 12. The vertical axes 164 of the the stationary hinge straps 92 need not be aligned. This mis-alignment could be for the same reasons as discussed in relation to the first embodiment. A variation by angle $\alpha$ where the base 135 of the stationary hinge strap 92 is mounted to the pillar 86 will result in relative change of orientation, as shown by angle $\alpha$, between the vertical axis 162 of the hinge pin 104 and the vertical axis 164 of the the stationary hinge strap 92, with the spherical convex surface 134 moving relative to the partial spherical concave surface 146.

Furthermore, since the vertical axes 162 and 164 of the hinge pin 104 and the stationary hinge strap 92 are not held relative to each other by a retaining bolt, as is done in the first embodiment, the hinge assembly 90 can adjust as the door is rotating. For example, if the movable hinge straps 94 of the hinge assemblies are slightly out of alignment with each other, the hinge pin 104 will adjust relative to the stationary hinge strap 92 as the door rotates to prevent binding of the hinge pin 104 with the stationary hinge straps 92. Therefore, the movable hinge strap 94 need not be aligned with a door swing axis.

The bellville washer 152 holds the hinge pin 104 snug against the plastic bearing 144 preventing the partial spherical convex surface 134 of hinge pin 104 from unseating when the door is open. The preload of the bellville washer 152 is sufficient to assure that the weigh of the door does not unseat the partial spherical convex surface 134 from the plastic bearing 144.

The vehicle door 14 can be easily removed by removing the retaining bolt 106 and lifting the door with the movable hinge strap 94 and then replaced without altering the vehicle door 14 fit. The conical section 126 of the hinge pin 104 and the conical portion 108 of the hinge pin receptacle portion 96 ease the alignment and insertion of the hinge pin 104 in the hinge pin receptacle portion 96.

While two embodiments of the present invention have been explained, various modifications within the spirit and scope of the following claims will be readily apparent to those skilled in the art.

The embodiments of the invention in which an exclusive property or privilege is claimed are defined as follows:

1. A hinge assembly pivotably mounting a vehicle door member to a body structure member about a door swing axis, the hinge assembly comprising:

a first hinge strap mounted to one of the members and having a vertical opening running along the door swing axis;

a second hinge strap mounted to the other member and having a spherical concave surface;

a hinge pin interposed between the hinge straps and having a portion received by the vertical opening in the first hinge strap and the hinge pin having a spherical convex surface for engaging the spherical concave surface of the second hinge strap for allowing variance in orientation of the second hinge strap relative to the door swing axis;

a retention means for rotatably retaining the hinge pin to the first hinge strap and for allowing relative rotation between the hinge pin and the first hinge strap;

said second hinge strap having a partial spherical convex surface remote from its concave surface and a hole extending between the spherical concave surface and the partial convex surface; said hinge pin having a threaded opening in communication with said convex surface on said hinge pin;

a washer having a spherical concave surface for engaging said spherical convex surface of the second hinge strap, and a retention bolt extending through said washer and through the opening of the second hinge strap and threadably engaged with said threaded hole of the hinge pin for retaining said washer and said hinge pin to said second hinge strap, said retention bolt being removable to allow said door member to be removed from the body structure member.

2. A hinge assembly pivotably mounting a vehicle door member to a body structure member about a door swing axis, the hinge assembly comprising:

a first hinge strap mounted to one of the members and having a vertical opening;

a second hinge strap mounted to the other member having a spherical concave surface and a hole opening onto the spherical concave surface;

a hinge pin interposed between the hinge straps and having a spherical convex surface engaging the spherical concave surface of the second hinge strap for allowing a variance in position of the hinge pin to the second hinge strap and the hinge pin having a portion projecting from the spherical convex surface and extending through the hole in the second hinge strap and received in said vertical opening in the first hinge strap and with the hinge pin having a pivot center through which the door swing axis extends;

a retention means for retaining the spherical convex surface of the hinge pin in engagement with the spherical concave surface of the second hinge strap and allowing relative rotation between the hinge pin and the second hinge strap about the pivot center of the hinge pin; said second hinge strap having a cylindrical bore and a plastic bearing carried in the cylindrical bore, said plastic bearing defining said spherical concave surface for said second hinge strap and engaging the spherical convex surface of the hinge pin, said retention means including a bellville washer carried in the cylindrical bore for retaining the spherical convex surface of the hinge pin in engagement with the spherical concave surface of said plastic bearing of the second hinge strap; and a removable retention bolt for retaining the hinge pin to said first hinge strap whereby the retention bolt allows removable retention of the door member to the body structure member and the concave and convex surfaces allows for variance in relative orientation of the second hinge strap to the door swing axis.

* * * * *